US005269027A

United States Patent [19]

Iatropoulos

[11] Patent Number: 5,269,027

[45] Date of Patent: Dec. 14, 1993

[54] DEVICE FOR UNPLUGGING DRAINS

[76] Inventor: Georges Iatropoulos, 3220 Avon, St-Hubert, Quebec, Canada, J3Y 5A4

[21] Appl. No.: 933,310

[22] Filed: Aug. 21, 1992

[30] Foreign Application Priority Data

Jun. 18, 1992 [CA] Canada ..... 2071591

[51] Int. Cl.[5] ..... E03D 11/00

[52] U.S. Cl. ..... 4/255.08; 285/12

[58] Field of Search ..... 4/255.01, 255.04, 255.08; 285/12, 177

[56] References Cited

U.S. PATENT DOCUMENTS

| | | | |
|---|---|---|---|
| 536,770 | 4/1895 | Vinter | 4/255.08 |
| 1,146,944 | 7/1915 | Middleton . | |
| 1,558,161 | 10/1925 | Gunderson . | |
| 1,963,522 | 6/1934 | Gavoza | 4/255.04 |
| 1,985,813 | 12/1934 | Baden . | |
| 1,988,198 | 1/1935 | German | 4/255.04 |
| 2,016,498 | 10/1935 | Hopewell . | |
| 2,061,553 | 11/1936 | Acosta . | |
| 2,197,716 | 4/1940 | Whitaker . | |
| 2,583,694 | 1/1952 | Fulton | 4/255.08 |
| 4,187,563 | 2/1980 | Semke . | |
| 4,790,356 | 12/1988 | Tash . | |

FOREIGN PATENT DOCUMENTS 17800 of 1911 United Kingdom .

*Primary Examiner*—Charles E. Phillips

*Attorney, Agent, or Firm*—Swabey Ogilvy Renault

[57] ABSTRACT

A device for unplugging drains comprises an elongated body defining therein a longitudinal bore and including a pair of opposed end sections each adapted to threadably receive a standard hose and provided with two different configurations of L-shaped lugs for connection to various drain pipe strainers. The device defines central outside threaded sections with an enlarged nut being engaged thereon. Between the central threaded sections and both the end sections are defined smooth annular neck sections adapted to receive a resilient annular member for sealing the mouth of the drain pipe when the device is mounted to the strainer thereof. Water supplied by the hose through the bore of the device provides water pressure in the drain pipe for unclogging the same. Various adapters which can be fitted to the end sections of the device are contemplated for allowing the device to be used with further drain configurations and also with compressed air.

12 Claims, 3 Drawing Sheets

DEVICE FOR UNPLUGGING DRAINS

BACKGROUND OF THE INVENTION

1. Field of the Invention

The present invention relates to an improved device for unplugging drain pipes which have become locked or restricted by an accumulation of foreign materials.

2. Description of the Prior Art

U.S. Pat. No. 1,558,161 issued on Oct. 20, 1925 to Gunderson discloses a drain cleaning device which comprises a hook to engage the guard cross provided in the drain pipe, a resilient plug, and a wing nut for causing the resilient plug to close the drain opening. Water can be supplied in the bore defined in the device to unplug the drain. Alternatively, pressurized air can be supplied in the drain cleaning device through a threaded extremity provided therefor on the device.

U.S. Pat. No. 2,197,716 issued on Apr. 16, 1940 to Whitaker discloses a drain cleaning device including a pair of L-shaped hooks which engage the guard cross of the drain, and a sealed plug to cover the opening of the drain pipe. Water is used in this device to unplug the drain pipe.

U.S. Pat. No. 2,583,694 issued on Jan. 29, 1952 to Fulton discloses a pair of L-shaped lugs adapted to engage the cruciform bar strainer of the drain pipe.

U.S. Pat. No. 4,790,356 issued on Dec. 13, 1988 to Tash contemplates the use of either pressurized air or water in a single adapter to unplug a drain pipe.

U.S. Pat. No. 1,985,813 issued on Dec. 25, 1934 to Baden teaches the use of a hook for engaging the spider of a drain pipe, and a rubber disk for sealing the pipe.

U.S. Pat. No. 2,061,553 issued on Nov. 24, 1936 to Acosta discloses a pair of hooks which are adapted to engage the spider of the drain pipe.

U.S. Pat. No. 4,187,563 issued on Feb. 12, 1980 to Semke discloses a flushing device including a resilient sealing disk for closing the drain opening and a pair of L-shaped members which define threaded portions for receiving nuts which urge the L-shaped members and bring the sealing means into scaling engagement with the pipe.

SUMMARY OF THE INVENTION

It is therefore an aim of the present invention to provide an improved device for unplugging drains.

It is also an aim of the present invention to provide a device for unplugging drains which can be adapted to more than one drain pipe configuration.

It is a further aim of the present invention to provide a device for unplugging drains which includes various adapters in order that it may be adapted to further configurations of drain pipes.

Therefore, in accordance with the present invention, there is provided a device for cleaning drains each including a mouth and a spider in the drain, the device comprising a body having first and second ends, said body defining a conduit means extending between said first and second ends, said first and second ends each being adapted for connection to a supply of fluid under pressure and including a pair of different connection means adapted for detachable connection to different configurations of spiders, at least one sealing means being provided on said body between said first and second ends for blocking the drain, wherein an appropriate one of said first and second ends is connected to the spider with the other end being connected to the supply of pressurized fluid, whereby the fluid will flow from said other end, through said conduit means and said one end and then in the drain for cleaning the same.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
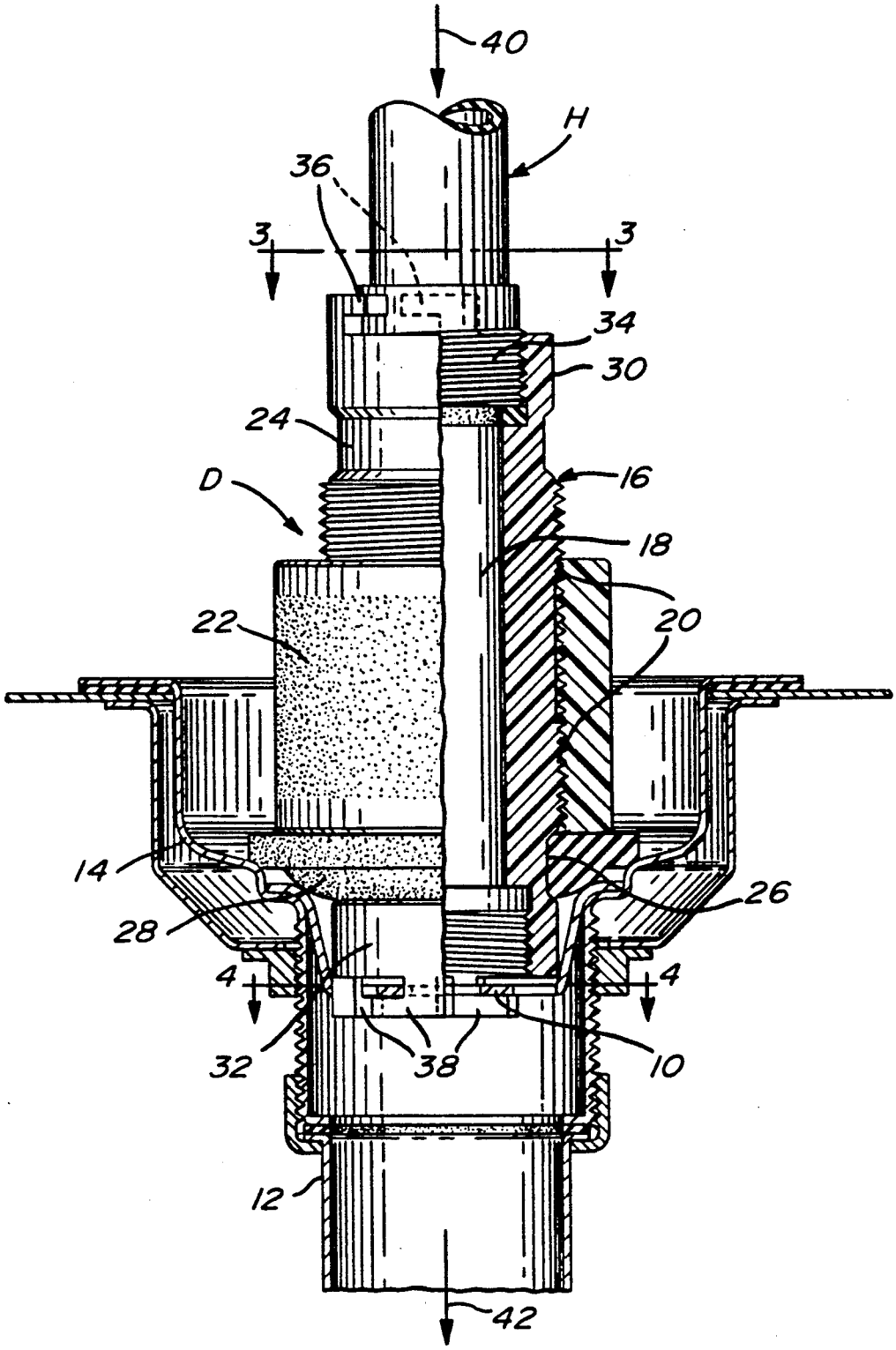
FIG. 1 is an elevation view shown partly in cross-section of a device for unplugging drains in accordance with the present invention and which is shown mounted to a drain opening and ready for operation.

In accordance with the present invention, FIG. 1 illustrates a device D for unplugging drains which is shown mounted to a strainer 10 provided transversely in a drain pipe 12 at a lower end of a mouth 14 thereof.

The device D includes an elongated body 16 defining therein a longitudinal bore 18. A pair of spaced apart threaded sections 20 are defined centrally on the outer surface of the body 16 with an enlarged nut defining a complementary inside thread being engaged on the central threaded sections 20. Outwardly of both central threaded sections 20 are defined a pair of smooth annular neck sections 24 and 26. The neck sections 24 and 26 are both adapted to receive thereon a resilient annular member 28, made of rubber or of a similar material, which is adapted to seal the mouth 14 of the drain pipe 12.

Figure 3:
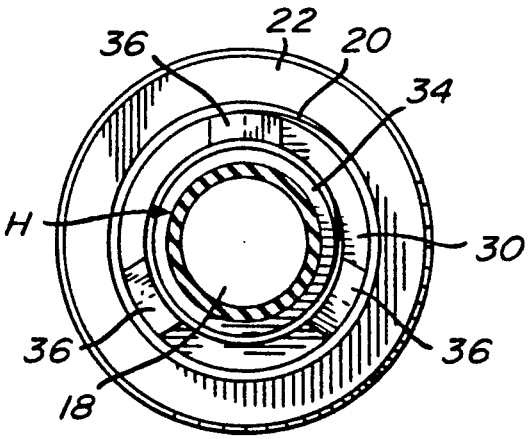
FIG. 3 is a cross-sectional view taken along lines 3—3 of FIG. 1.
Figure 4:
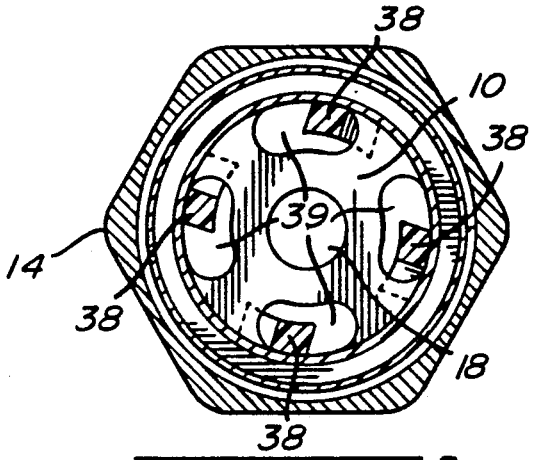
FIG. 4 is a cross-sectional view taken along lines 4—4 of FIG. 1.

End sections 30 and 32 are provided on the body 16 adjacent the neck sections 24 and 26, respectively. Each of the end sections 30 and 32 defines an inside thread adapted to receive a threaded end 34 of a hose H for connecting the latter to the body 16 of the device D. The end section 30 is provided at its longitudinal free end with three identical L-shaped lugs 36, whereas the longitudinal free end of the end section 32 is provided with four identical L-shaped lugs 38. The distribution and shape of these L-shaped lugs 36 and 38 are well illustrated in FIGS. 3 and 4, respectively. The L-shaped lugs 36 or 38 are adapted to be engaged under the strainer 10 of the mouth 14 of the drain pipe 12. In the case of a strainer 10 as illustrated in FIG. 4, the end section of the body 16 of the device D must include four L-shaped lugs, such as the L-shaped lugs 38. The L-shaped lugs 38 are inserted in the openings 39 defined in the strainer 10, and the device D is then rotated in order that the horizontal sections of the L-shaped lugs 38 at least partially become engaged behind the strainer 10, as best seen in phantom lines in FIG. 4. If the strainer 10 defines three equidistant oblong openings instead of the four openings 39 shown in FIG. 4, the end section 30 with its three L-shaped lugs 36 will be used for mounting the device D to the strainer of the mouth of the drain pipe.

Once the proper end of the device D has been chosen the resilient annular member 28 is positioned on the appropriate neck section 24 or 26. The device D is then mounted to the strainer by way of the L-shaped lugs, after which the enlarged nut 22 is screwed to tightly hold in sealing relation the resilient annular member 28 against part of the mouth 14 of the drain pipe 12. The hose H can then be connected to the other end section of the device D, although this step can be more easily accomplished before the device D is mounted to the strainer 10. Water pressure supplied in the hose H will flow through the bore 18 of the body 16 of the device D, through the end section thereof connected to the strainer, and then through the drain pipe so as to unplug the drain pipe of the foreign materials which have accumulated therein and have either obstructed or restricted the flow through the drain pipe.

For example, in the case of a drain pipe having a mouth and a strainer such as those illustrated in FIGS. 1 and 4, the end section 32 which includes four L-shaped lugs 38 will be used for mounting the device D to the strainer 10 of the mouth 14 of the drain pipe 12. The resilient annular member 28 which was previously positioned on the neck section 26 prior to the assembly of the device D to the strainer 10 is then tightly urged against the mouth 14 of the drain pipe 12 with the enlarged nut 22. Water can then be supplied from the hose H along the direction shown by arrow 40 into the bore 28 of the body 16 of the device D, with the water then flowing through the drain pipe 12 along the direction shown by arrow 42. Once the drain pipe 12 has been freed from the foreign materials which had accumulated therein, the device D is removed by rotating the body 16 in such a way as to disengage the L-shaped lugs 38 from the strainer 10.

Again, if a tree-opening strainer is encountered, the end section 30 with its three L-shaped lugs 36 is used to mount the device D to this strainer with the hose H being connected at its threaded end 34 to the threads defined inside the end section 32 of the body 16 of the device D. It is necessary to position the resilient annular member 28 on the appropriate neck section 24 or 36 prior to the assembly of the end section 30 or 32 to the strainer. It is also contemplated to provide two such resilient annular members 28 which are maintained at all times on both the neck sections 24 and 26.

Figure 2:
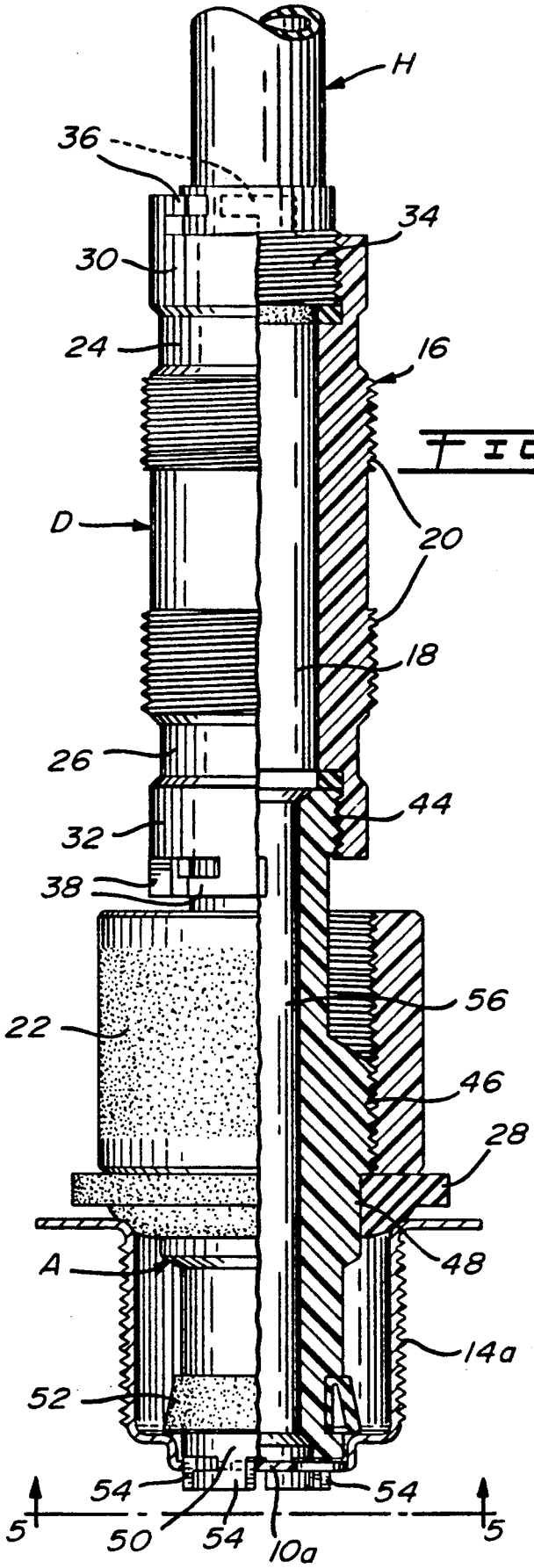
FIG. 2 is an elevation view partly in cross-section of the device shown in FIG. 1 and fitted with an adapter for smaller drain openings, and shown mounted thereto and ready for operation.

The device D shown in FIG. 1 is for use with drain pipes having large mouths, such as those found in kitchen sinks. If drain pipes with smaller mouths are encountered, the device D of FIG. 1 is fitted with an adapter A which is shown in FIG. 2. This adapter A is of smaller diameter and is intended for use with drain pipes having smaller mouths, such as in bathtubs or in bathroom sinks.

The adapter A includes a first end 44 threaded on its outer surface for allowing the adapter A to be mounted to either one of the end sections 30 and 32 of the device D. The outer surface of the adapter A defines a threaded section 46 near its center for receiving the enlarged nut 22. The adapter A also defines a smooth annular section 48 for receiving the resilient annular member 28. A second end 50 of the adapter A is provided with a resilient collar 52 and, in the embodiment shown in FIG. 2, with four L-shaped lugs 54 for engaging a strainer 10*a* provided at the lower end of a mouth 14*a* of the drain pipe that the user wishes to unclog. The adapter A defines a longitudinal bore 56 which communicates with the bore 18 of the device D.

Figure 5:
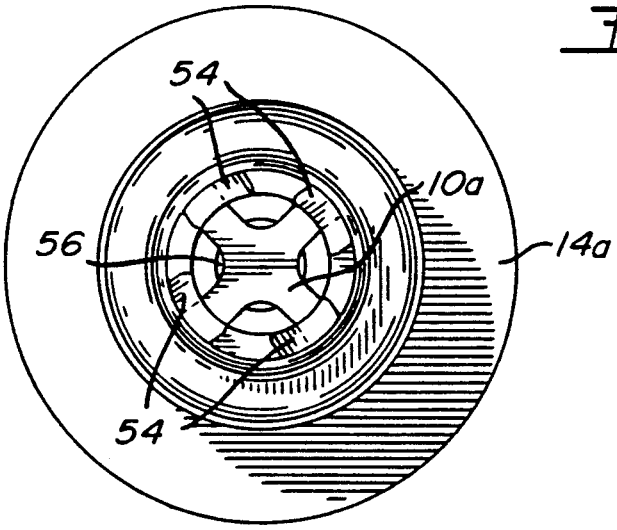
FIG. 5 is a bottom plan view taken along lines 5—5 of FIG. 2.

In the embodiment of FIG. 2, the hose H is connected at its threaded section 34 to the end section 30 of the device D. The first end 44 of the adapter A is threadably engaged in the end section 32 of the device D. The enlarged nut 22 of the device D has been repositioned on the central section 46 of the adapter A, and the resilient annular member 28 of the device D has been repositioned on the annular section 48 of the adapter A. The four L-shaped lugs 54 provided at the second end 50 of the adapter A are engaged under the strainer 10*a* with the resilient collar 52 preventing, such as the resilient annular member 28, a backlash of the water supplied through the hose H in the bores 18 and 56 of the device D and of the adapter A, respectively. The connection of the four L-shaped lugs 54 to the cruciform shaped strainer 10*a* is best illustrated in FIG. 5.

Figure 6:
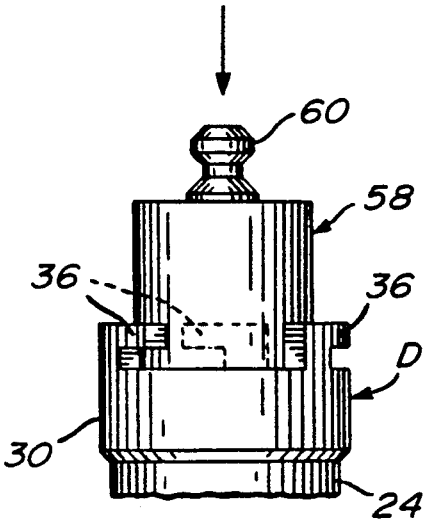
FIG. 6 is a fragmented elevational view of a compressed air adapter fitted to the device of FIG. 1.

FIG. 6 illustrates a compressed air adapter 58 which includes an outer surface defining a threaded end, such as the threaded first end 44 of the adapter A, for connection to either one of the end sections 30 and 32 of the device D. The compressed air adapter 58 also includes a standard nipple 60 at the other end thereof for connection to a compressed air supply in the event that it is desired to unclog the drain with compressed air instead of with water.

It is easily seen from the above that the present invention provides a simple universal device for unplugging drains with various adapters being provided for accommodating various configurations of drain pipe mouths and strainers. With the standard device D offering connections for two different drain pipe configurations, various adapters A can be fitted to the present device D to allow the device D to be used with further drain pipe configurations.

It is noted that in the preferred embodiments described hereinabove and illustrated herein, every part of the device D and of the adapter A is made of a plastics material, aside from the resilient annular member 28 and the resilient collar 52 which are both made of rubber.

I claim:

1. A device for cleaning drains of the type including an entrance mouth and a spider therebelow in the drain, the device comprising a body having first and second ends, said body defining a fluid passage extending between said first and second ends, said first and second ends each having means for connection to a supply of fluid under pressure and each end having one of a pair of different connection means adapted for detachable connection under different configurations of spiders, at least one sealing means being provided on said body between said first and second ends for blocking said drain mouth, wherein an appropriate one of said first and second ends is connected to the spider by its connection means with the other end being connected to the supply of pressurized fluid by its means for connection to a supply, whereby the fluid will flow from said other end, through said fluid passage and said one end and then in the drain for cleaning the same.

2. A cleaning device as defined in claim 1, wherein said sealing means comprises a nut threadably engaged on said body between said first and second ends for longitudinal displacement therebetween, and a resilient annular member positioned between said nut and said one end, whereby, once said one end is secured to the spider, said nut is displaced towards said one end into urging abutment with said resilient member for sealing the mouth of the drain.

3. A cleaning device as defined in claim 2, wherein an annular smooth neck is defined on said body between said nut and each one of said first and second ends for receiving said resilient annular member.

4. A cleaning device as defined in claim 2, wherein said resilient annular member can be selectively positioned on either side of said nut depending on which one of said first and second ends is being detachably secured to the spider.

5. A cleaning device as defined in claim 1, wherein said first and second ends each comprise a tubular free end.

6. A cleaning device as defined in claim 5, wherein said tubular free end defines an inside thread adapted for connection to the threaded end of a standard hose.

7. A cleaning device as defined in claim 5, wherein hook means extend outwardly from said tubular free end for connection to the spider.

8. A cleaning device as defined in claim 7, wherein said connection means comprises hook means including at least two L-shaped lugs.

9. A cleaning device as defined in claim 8, wherein said hook means of said first and second ends comprise respectively four L-shaped lugs for connection to a cruciform-shaped spider and three L-shaped lugs for connection to a three-arm spider.

10. A cleaning device as defined in claim 1, wherein said device also comprises an adapter means including first and second ends and defining a fluid passage therebetween, one of said first and second ends being adapted for connection to said first and second ends of said body with the other end including a further connection means adapted for detachable connection to a spider configuration different than those for which said first and second ends of said body are intended, said sealing means being adaptable on said adapter means adjacent said other end thereof for blocking the drain when said other end of said adapter means is connected to the spider with said one of said first and second ends of said body being connected to the pressurized fluid while the other end of said first and second ends of said body is connected to said one end of said adapter means, whereby the fluid will flow from said one end of said body, through said other end of said body and through said one end of said adapter means, and then through said other end of said adapter means and in the drain for cleaning the same.

11. A cleaning device as defined in claim 10, wherein said other end of said adapter means includes a further sealing means inwards of said further connection means thereof.

12. A cleaning device as defined in claim 1, wherein said device also comprises an adapter means having first and second ends with one end being adapted for connection to either one of said first and second ends of said body while the other end of said adapter means is provided with a nipple means adapted for connection to a pressurized air source whereby pressurized air is supplied through said adaptor means and said fluid passage towards the drain for cleaning the same.

* * * * *